US008424261B2

(12) United States Patent
Collier et al.

(10) Patent No.: US 8,424,261 B2
(45) Date of Patent: Apr. 23, 2013

(54) COMPOSITE BUILDING BLOCK HAVING MOISTURE BARRIER AND INSULATION ELEMENT

(76) Inventors: Peter Collier, New South Wales (AU); Judi Collier, New South Wales (AU)

( * ) Notice: Subject to any disclaimer, the term of this patent is extended or adjusted under 35 U.S.C. 154(b) by 35 days.

(21) Appl. No.: 12/424,942

(22) Filed: Apr. 16, 2009

(65) Prior Publication Data

US 2009/0199499 A1 Aug. 13, 2009

Related U.S. Application Data

(63) Continuation of application No. 10/806,592, filed on Mar. 23, 2004, now abandoned.

(30) Foreign Application Priority Data

Mar. 24, 2003 (AU) ..... 2003901351

(51) Int. Cl.
*E04C 1/41* (2006.01)

(52) U.S. Cl.
USPC ..... 52/309.12; 52/307.17

(58) Field of Classification Search ..... 52/309.14, 52/309.17, 390.9, 309.12
See application file for complete search history.

(56) References Cited

U.S. PATENT DOCUMENTS

| | | | | | |
|---|---|---|---|---|---|
| 3,148,477 | A | * | 9/1964 | Bjorn et al. | 52/591.2 |
| 4,055,928 | A | * | 11/1977 | Magerle | 52/612 |
| 4,190,995 | A | * | 3/1980 | Armistead | 52/309.9 |
| 4,557,094 | A | * | 12/1985 | Beliveau | 52/405.4 |
| 4,986,049 | A | * | 1/1991 | Kennedy et al. | 52/309.12 |
| 5,230,195 | A | | 7/1993 | Sease | |
| 5,365,714 | A | | 11/1994 | Potvin | |
| 5,471,808 | A | | 12/1995 | De Pieri et al. | |
| 5,505,034 | A | | 4/1996 | Dueck | |

* cited by examiner

*Primary Examiner* — Michael Safavi
(74) *Attorney, Agent, or Firm* — Galgano & Associates, PLLC; Thomas M. Galgano; Jessican G. Bower

(57) ABSTRACT

A construction block for use in the construction of elemental structures, including a body having a bottom surface, a top surface, end surfaces, an outer surface which forms part of an outer surface of a structure and an inner face. At least one formation on or in at least the inner face and/or at least one of the end faces receives and retains at least one insulating element. The insulating element provides thermal insulation for the structure formed from such construction blocks.

9 Claims, 7 Drawing Sheets

COMPOSITE BUILDING BLOCK HAVING MOISTURE BARRIER AND INSULATION ELEMENT

CROSS-REFERENCE TO RELATED APPLICATION

This application is a continuation of application Ser. No. 10/806,592 filed on Mar. 23, 2004, now abandoned.

BACKGROUND

The present invention relates to an improved composite building block and a method of construction using such building blocks using a selected blend of ingredients forming a mortar matrix and an insulating element. More particularly, the present invention relates to an insulating element for use in the construction of a composite building block and in wall constructions using such building blocks. More particularly the present invention provides a building block and a wall constructed from such blocks having superior waterproofing, thermal and insulating properties due to the use of the insulating element.

PRIOR ART

There are in existence a wide variety of building blocks each tailored to suit an individual application.

Numerous construction materials have been provided in the prior art. For example, U.S. Pat. Nos. 5,230,195 to Sease; 5,365,714 to Potvin; 5,471,808 to De Pieri et al. and 5,505,034 to Dueck all are illustrative of such prior art and are incorporated by reference herein. While these units may be suitable for the particular purpose to which they address, they would not be as suitable for the purposes of the present invention to be described herein below.

U.S. Pat. No. 5,230,195 discloses an insulating molded plastic building unit comprising a rectangular parallelepiped without a rear wall. One or more alignment bosses extending upwardly and outwardly from an upper wall of the building unit are equidistantly spaced from a front face and a side face thereof to cooperatively align with alignment sockets of automatically space superimposed building units. Each building unit has vertical and diagonal webs for structural reinforcement thereof. Cavities within each building unit can be filled with insulating material to enhance the insulating characteristics thereof. A plurality of the building units are laid in courses with joints formed therebetween with waterproof adhesive.

U.S. Pat. No. 5,365,714 discloses a wall for a rampart or building, consisting of a plurality of building blocks, each comprising slightly compacted sawdust or wood chips glued with resin. The building blocks are interconnected by a number of assembling pins and by recesses integral to the respective blocks, so as to frictionally engage into one another. There are also provided full length projections and corresponding grooves of the respective blocks for the same purposes. The structure is remarkable by the quality of the joints and by the ease and quickness of its assembly or disassembly.

Another building block is disclosed in U.S. Pat. No. 5,471,808. The building block has a hollow body with lateral surfaces which bear a decorative finish, a flat upper surface having studs protruding therefrom, and a bottom opening defining seats for accommodating the upwardly protruding studs of an underlying block. A frog is formed in the flat upper surface for permitting the introduction of an adhesive medium between adjacent blocks. The block can be provided with a framework having an upper frame and legs for interposition between adjacent blocks.

U.S. Pat. No. 5,505,034 discloses a block for forming a retaining wall comprising a generally parallelepiped body with front, rear, top, bottom and side surfaces and a central internal cavity with internal walls. Integrally formed protruding knobs are formed on the bottom surface adjacent the front surface and are positioned for protruding into the central cavity of at least one other block in a wall formed from the blocks.

None of the above examples of the prior art disclose a building block manufactured in accordance with the method to be described herein and which have improved insulating properties.

INVENTION

The present invention provides an alternative to the known building blocks and particularly lightweight blocks having improved insulating and moisture resistance properties. In its broadest form the present invention comprises:

a construction block for use in the construction of elemental structures, the block comprising a body having a bottom surface, a top surface, end surfaces, an outer surface which forms part of an outer surface of a structure and an inner face; at least one formation on or in at least the inner face and/or at least one of the end surfaces which receive/s and retain/s at least one insulating element; wherein, the insulating element provides thermal insulation for a structure formed from said construction blocks.

In another broad form the present invention comprises:

a polystyrene insulating element for use in the thermal insulation of a wall constructed from building blocks made from a cementitious material wherein said element approximates the size of at least one face of a building block with which the insulating element is used, wherein the polystyrene insert is adapted for integral attachment with at least one said building blocks such that a composite building element comprising said element and at least one said blocks is formed.

In another broad form the present invention comprises:

an insulating element for use in a construction block for use in the construction of elemental structures, the block comprising: a body having a bottom surface, a top surface, end surfaces, an outer surface which forms part of an outer surface of a structure and an inner face; at least one formation on or in at least the inner face and/or at least one of the end surfaces which receive/s and retain/s at least one insulating element; wherein, the insulating element provides thermal insulation for a structure formed from said construction blocks.

In another broad form the present invention comprises:

an insulating element for use in the thermal insulation of a wall constructed from building blocks made from a cementitous material; wherein, said element approximates the size of at least one face of a building block with which the insulating element is used, wherein, the polystyrene insert is adapted for integral attachment with at least one said building blocks such that a composite building element comprising said element and at least one said blocks is formed.

In another broad form the present invention comprises:

a structure manufactured from building blocks comprising a body having a bottom surface, a top surface, end surfaces, an outer surface which forms part of an outer surface of a structure and an inner face; at least one formation on or in at least the inner face and/or at least one of the end surfaces which receive/s and retain/s at least one insulating element; wherein, the insulating element provides thermal insulation for the structure formed from a composite building element comprising said blocks and said insulating element.

In another broad form the present invention comprises:

a composite building block including an insulating element wherein the element provides a thermal and moisture barrier to said block wherein, said composite is prepared in a mould and the block is formed from a cementitious matrix; wherein said matrix is poured in said mould while said polystyrene element is in said mould; wherein the element and block mutually engage by opposing gender formations to form the composite block.

In another broad form the present invention comprises a method of construction of a block wall having an insulating layer; wherein the method comprise the steps of:

a) taking a mould for forming at least one building block;
b) preparing a cementitious matrix for formation of said blocks;
c) placing at least one element having insulating properties in said mould;
d) pouring said matrix into said mould such that the matrix engages mould surfaces and at least one surface of said element;
e) allowing said matrix to set for a predetermined period of time;
f) removing said at least one block and said at least one element from said mould;
g) constructing a wall from said blocks and associated at least one element thereby producing a structure having increased insulating properties by virtue of said at least one insert.

In another broad form the present invention comprises:

a composite building block and polystyrene element wherein the polystyrene element provides a thermal and moisture barrier to said block wherein said composite is prepared in a mould, the block formed from a cementitious matrix including timber aggregate; wherein said matrix is poured in said mould while said polystyrene element is in said mould.

In another broad form of a method aspect the present invention comprises:

a method of preparation of a structure formed from composite building blocks the method compring the steps of:

a) placing a mould of predetermined dimensions on a base surface;
b) placing a polystyrene element in said mould;
c) mixing a matrix of cementitious material and pouring said material into said mould so that the material forms at least one block;
d) allowing said element to engage said matrix so that said element forms a composite with said matrix;
e) allowing said matrix to set for a predetermined period;
f) removing said composite element and matrix from said mould.

According to one embodiment, the method comprises the additional step before placing said polystyrene element in said mould of providing means on the mould to allow the element to key into said matrix. Preferably the mould comprises walls defining an internal space but without a base or lid so that a through passage is provided. Preferably, the moulds are four sided but it will be appreciated that composite blocks of alternative shapes and configurations may be formed by alternative mould shapes.

According to a preferred embodiment, the polystyrene element is generally elongate but includes on at least one surface, projections which "key" into the cementitious matrix to ensure that the insert always retains its predetermined disposition and unwanted movement is prevented.

In another broad form of the method aspect the present invention comprises:

a method of preparation of a structure formed from building blocks prepared in a mould; the method comprising the steps of:

a) forming a cement of clay fired moulded block such that the finished block includes surface formations therein on at least one surface;
b) taking at least two of said blocks and placing said blocks so that said formations on said at least one surface of two said blocks are in spaced apart but opposing relationship to form a cavity therebetween;
c) filling said cavity between said at least two blocks with a flowable material capable of filling said cavity;
d) allowing said flowable material to set thereby creating a composite building element comprising said two blocks and said flowable material.

According to a preferred embodiment, the flowable material is a foaming polyurethane or styrene or like product. The foaming product is preferably low density and fully penetrates the cavity formed between said blocks to form an insulating layer imparting to the building block superior insulating properties and a barrier to moisture. Preferably two opposing bricks are placed with keys facing each other set to a predetermined width.

a) preparing a mould;
b) placing a polystyrene element in said mould;
c) mixing a matrix of cementitious material and pouring said material into said mould so that the material forms at least one block;
d) allowing said element to engage said matrix so that said element forms a composite with said matrix;
e) allowing said matrix to set for a predetermined period;
f) removing said composite element and matrix from said mould.

BRIEF DESCRIPTION OF DRAWINGS

The present invention will now be described in more detail according to a preferred but non limiting embodiment and with reference to the accompanying illustrations wherein.

DETAILED DESCRIPTION OF PREFERRED EMBODIMENT

Figure 1:
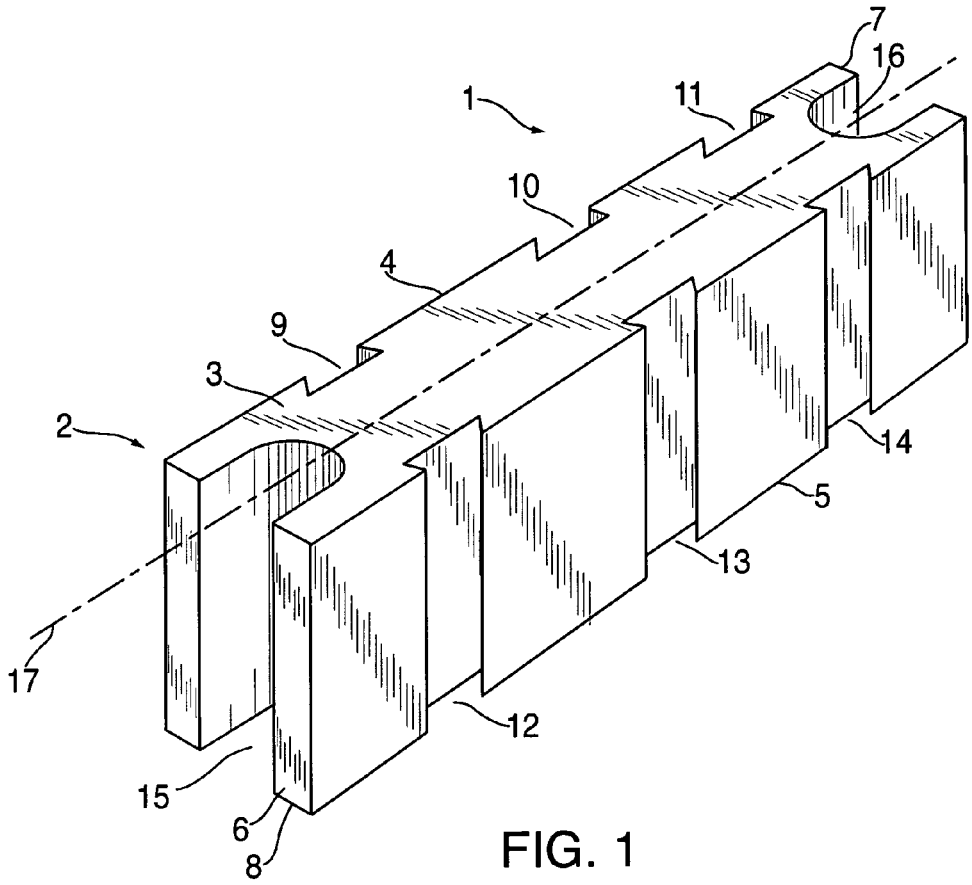
FIG. 1 shows a perspective view of a polystyrene insulating element according to one embodiment.

FIG. 1 shows a perspective view of a polystyrene insulating element profile 1 according to one embodiment. Element 1 is adapted for use in building blocks used in the construction of structures and preferably elemental structures such as but not limited to walls both structural and internal non load bearing. Element 1 is integrally fitted to a construction block during manufacture of the block such that an integral composite is formed or it may be fitted after construction of the block and during construction of a structure in which the blocks are to be used.

Figure 2:
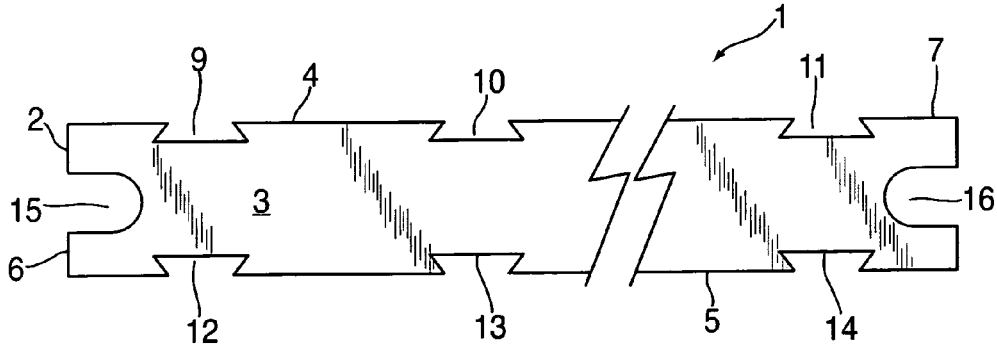
FIG. 2 shows a plan view of the insulating element of FIG. 1 of indefinite length.

Preferably, element 1 comprises a prismic body made from a material having high insulating properties and is insertable adjacent or in at least one of said building blocks to thereby provide a thermal and water barrier to at least one face of each of said building blocks. In a preferred embodiment, element 1 is generally elongate and approximates the length of a brick with which it will be used. For the purpose of integral engagement of element 1 and an adjacent brick or block, element 1 may according to one embodiment, typically comprise a generally elongate body 2 comprising a top 3 side walls 4 and 5, end walls 6 and 7 and bottom 8. Wall 4 includes dovetail formations 9, 10 and 11 and wall 5 includes formations 12, 13 and 14. Each formation provides a keying in profile for mutual engagement between an element and a block, as seen best in FIG. 13. Formations 9-14 allow element 1 to embed in a cementitious matrix formed for construction of a construction block with which element 1 is suitable for use. Element 1 may be of definite length as shown in FIG. 1 or indefinite length as shown in FIG. 2 depending upon job requirements. Preferably, the length of element 1 will be about the length of a building block. Element 1 further comprises end profiles 15 and 16 formed respectively in end walls 6 and 7 and which facilitate locking engagement with a corresponding insulating element in an adjacent (end to end) construction block.

Formations 9-14 are preferably angled at approximately 75 degrees but it will be appreciated that this and other dimensions of the formations may be varied according to prescription.

The formations are a predetermined width, depth and shape so as to maximise the keying or binding effect between element 1 and it's adjacent construction block without encroaching too deeply into the body 2 of element 1. Each key formation 9-14 may be spaced apart so that each is offset to its counter part on an opposite wall. Element 1 of FIG. 1 shows formations disposed symmetrically about longitudinal axis 17.

Figure 3:
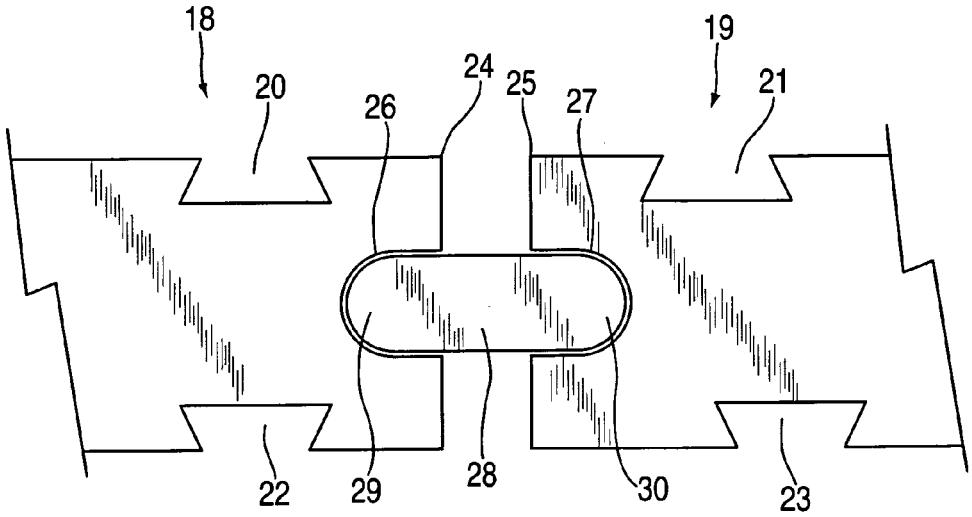
FIG. 3 shows an abbreviated plan view of opposing insulating elements as they would be disposed in adjacent end to end blocks.

FIG. 3 shows a top view of opposing longitudinally disposed styrene elements 18 and 19. Elements 18 and 19 include respective dovetail formations 20 and 21 on one face and formations 22 and 23 on an opposing face. Elements 18 and 19 have respective opposing ends 24 and 25. End 24 includes a recess 26 and end 25 includes a recess 27. An insert 28 is placed intermediate elements 18 and 19 such that end 29 of insert 28 engages recess 26 and end 30 of insert 28 engages recess 27.

Figure 4:
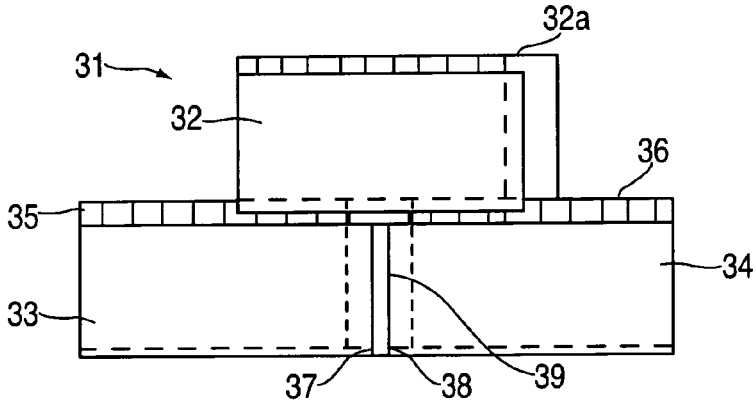
FIG. 4 shows an elevation view of a wall section comprising three composite blocks and styrene insulating elements inserted.

FIG. 4 shows an elevation view of a wall section 31 comprising three construction blocks 32, 33 and 34. Blocks 33 and 34 receive polystyrene inserts 35 and 36. Opposing ends 37 and 38 of blocks 33 and 34 respectively, receive polystyrene insert 39 which provides a key to secure ends 37 and 38. Block 32 receives polystyrene insert 32*a*.

Figure 5:
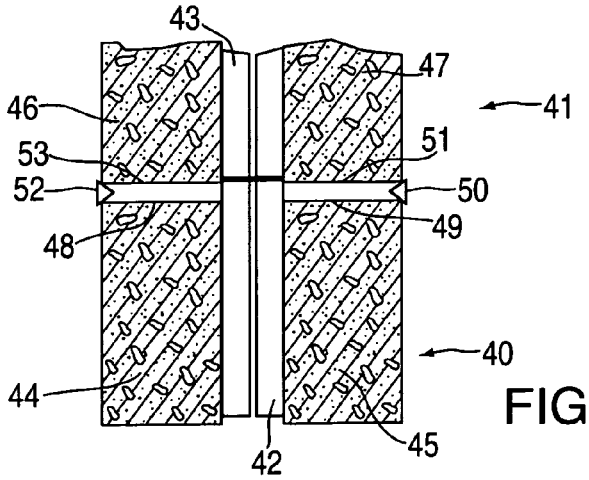
FIG. 5 shows an end elevation of two courses of blocks spaced apart by polystyrene elements according to a preferred embodiment.

FIG. 5 shows an end elevation of two courses of blocks 40 and 41 spaced apart by polystyrene elements 42 and 43 according to a preferred embodiment. The arrangement shown comprises foundation blocks 44 and 45 spaced apart by element 42 and which receive and support a second course of blocks 46 and 47. Blocks 46 and 47 are spaced apart by element 43. Element 42 disposed between blocks 44 and 45, sits proud of upper surfaces 48 and 49 at its upper extremity. Preferably, according to a method aspect, blocks 45 and 47 are kept spaced apart by temporary wedge 50 whereupon mortar may be forced into gap 51. Likewise wedge 52 separates blocks 44 and 46 allowing mortar to be introduced into gap 53.

Figure 6:
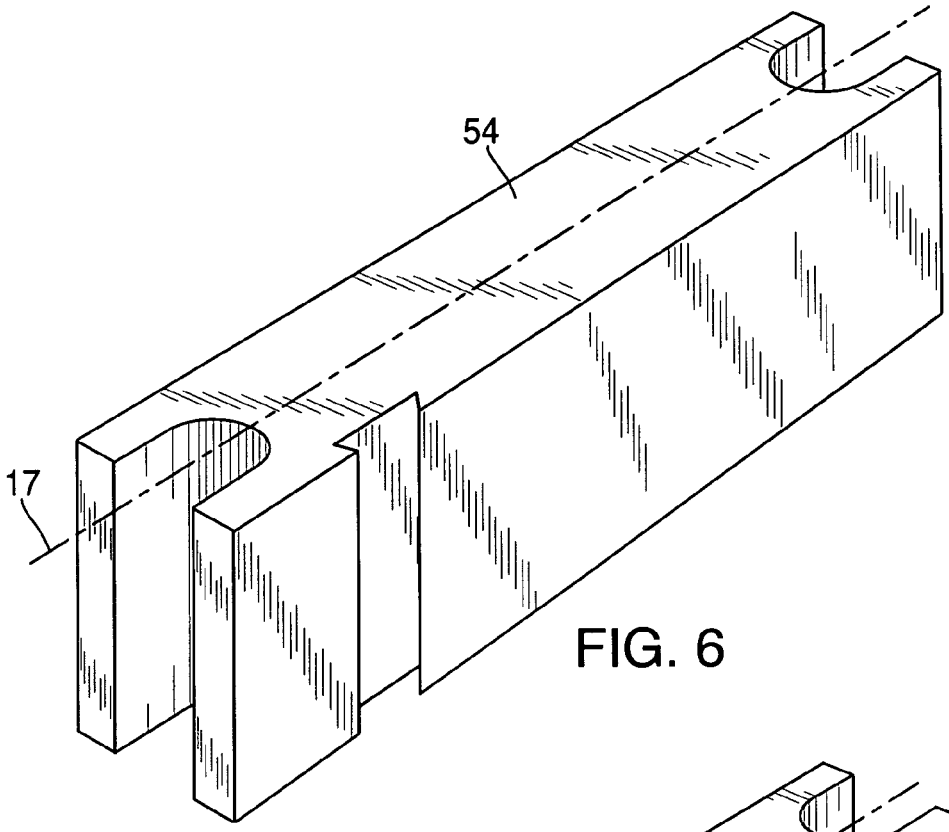
FIG. 6 shows a perspective view of an insulating element insert according to an alternative embodiment.
Figure 7:
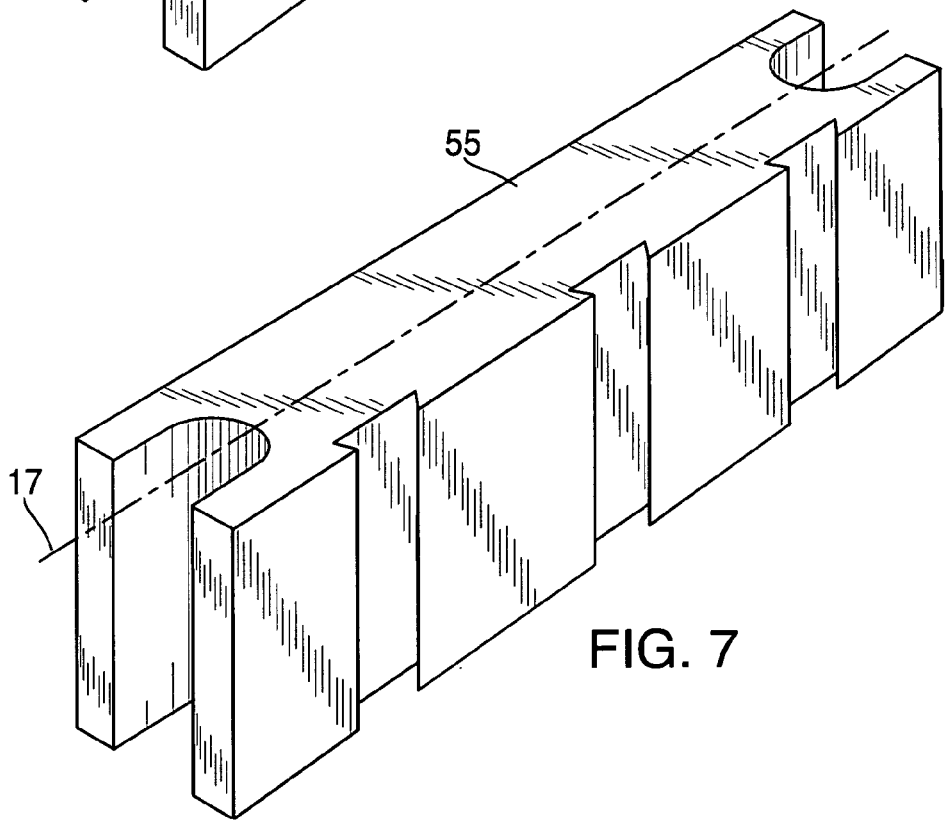
FIG. 7 shows a perspective view of an insulating element insert according to an alternative embodiment.

FIG. 6 shows a perspective view of an insulating element 54 according to an alternative embodiment FIG. 7 shows a perspective view of an insulating element 55 according to an alternative embodiment. Element 55 has a higher height dimension than element 54. In the embodiments shown each has only one side wall formation for engagement with a corresponding block not shown. It will be appreciated that there could be any number of formations in the sidewalls of a typical element or there may be none in the case where total reliance is placed on end to end fastening of opposing elements.

Figure 8:
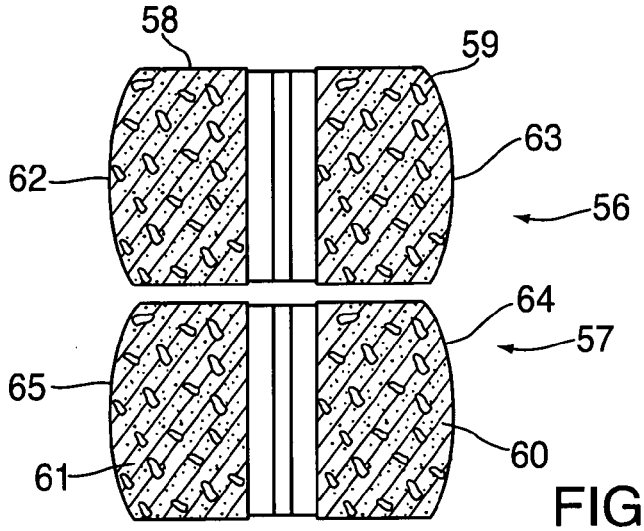
FIG. 8 shows an end view of two courses of cobblestone blocks according to an alternative embodiment and including insulating elements.
Figure 9:
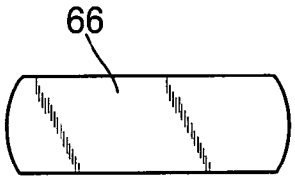
FIGS. 9 and 10 show end views of respective mould elements for preparing an end profile in a block according to a preferred embodiment.
Figure 10:
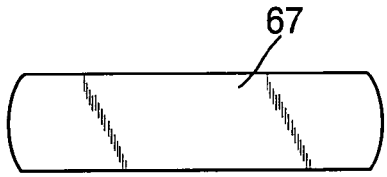
Figure 11:
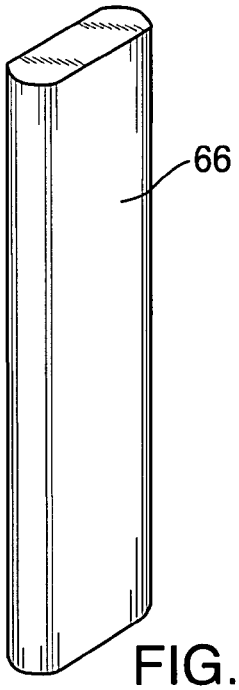
FIGS. 11 and 12 show perspective views of different proportioned respective mould elements for preparing an end profile according to a preferred embodiment.
Figure 12:
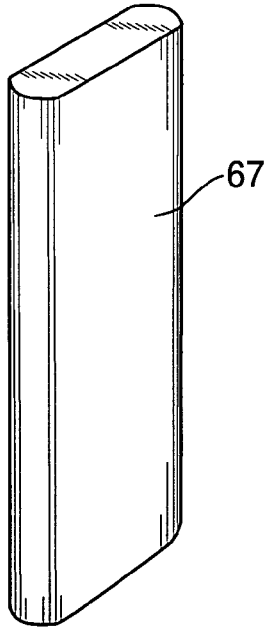

FIG. 8 shows an end view of two courses 56 and 57 of cobblestone blocks 58, 59, 60 and 61 according to an alternative embodiment. In the example shown, respective outer faces 62, 63, 64 and 65 of blocks 58, 59, 60 and 61 each have a radiused curve which enhances the external appearance of the blocks. As previously described the block arrangement shown includes insulating element disposed between blocks, FIGS. 9 and 10 show end views of respective mould elements 66 and 67 for preparing an end profile in a block according to a preferred embodiment; and FIGS. 11 and 12 show perspective views of different proportioned respective mould elements 66 and 67 for preparing an end profile of an insulating element according to a preferred embodiment.

Figure 13:
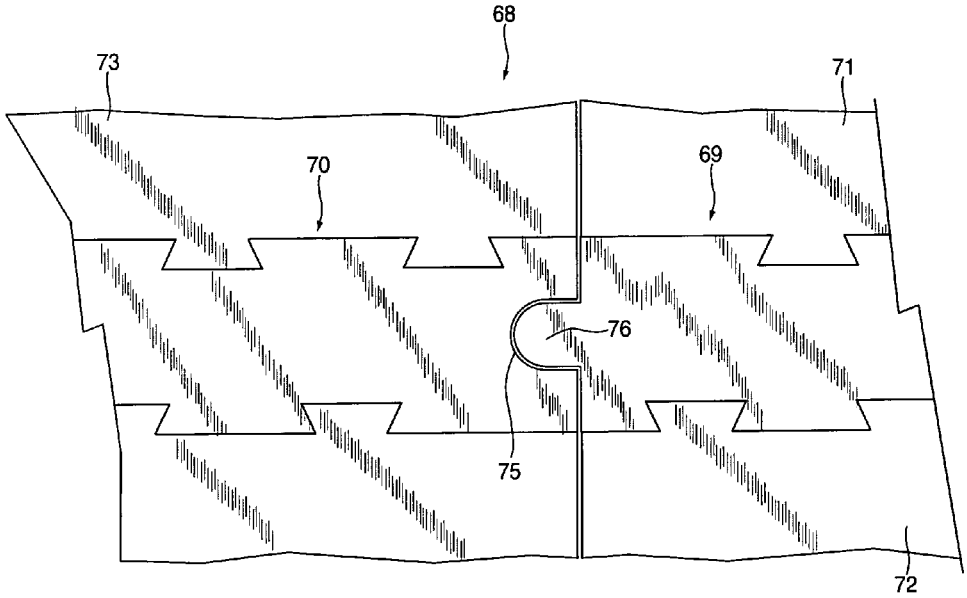
FIG. 13 shows a plan view of a polystyrene insert with interlocking key engaging an adjacent insert.

FIG. 13 shows a plan view of an insulating element arrangement 68 comprising mating styrene elements 69 and 70. Element 69 separates blocks 71 and 72 and element 70 separates blocks 73 and 74. According to the embodiment shown, element 70 includes a female gender profile 75 which engages corresponding male gender profile tongue 76 to ensure secure interfitting between elements 69 and 70.

According to one embodiment, element 70 preferably protrudes past a block end forming tongue 76 but leaves a concave 75 at its opposite end. The tongue and groove arrangement creates a continuous unbroken styrene section from block to block so as not to compromise the R value in perpendicular joints. The tongue and groove arrangement ensures that each block is perfectly aligned with it's neighbouring blocks, thus reducing the risk of human error in laying the blocks. The tongue and groove also ensures the perpendicular joints are of equal width and reduces the possibility of air flow and water penetration through the perpendicular joints as a result of poor brick laying.

According to a preferred embodiment blocks referred to throughout this specification are preferably made from a cementitious matrix which includes cellulose or timber aggregate. However, it will be appreciated that other matrix mixes may be used according to requirements.

The polystyrene elements described herein are adapted for integral attachment with at least one of said building blocks such that a composite building element comprising polystyrene element and at least one said blocks is formed.

According to one method aspect, construction of a block wall having an insulating layer; comprises the following steps. First a mould is prepared for forming building blocks. A cementitious matrix is mixed for formation of the blocks.

At least one element having insulating properties is placed in the mould, whereupon a cement slurry is poured into the mould such that the matrix engages mould surfaces and at least one surface of the element. The matrix is allowed to dry/set for a predetermined period of time whereupon the at least one block and at least one element is separated from said mould. A structure such as a wall is then constructed using the composite blocks formed from the integrally attached block and insulating element. The so formed structure has increased insulating (and waterproofing) properties by virtue of the at least one element.

According to one embodiment, the method comprises the additional step before placing the polystyrene insert in said mould of providing means on the mould to allow the element to key into the matrix. Preferably the mould comprises walls defining an internal space but without a base or lid so that a through passage is provided. Preferably, the moulds are four sided but it will be appreciated that composite blocks of alternative shapes and configurations may be formed by alternative mould shapes.

In another embodiment, there is provided a method of preparation of a structure formed from clay fired building blocks prepared in a mould. A finished block includes surface formations therein on at least one surface, such that at least two blocks are placed so that the formations on at least one surface of the two blocks are in spaced apart but in opposing relationship to form a cavity therebetween. The cavity between at least two blocks with a flowable material capable of filling the cavity. Preferably the flowable material is a foaming polyurethane or styrene or like product. The foaming product is preferably low density and fully penetrates the cavity formed between said blocks to form an insulating layer imparting to the building block superior insulating properties and a barrier to moisture.

Preferably each block is single skin and load bearing so as to reduce the cost and increase the speed of building and to increase the R value (insulation). A styrene insert of approximately 40 mm width will increase the R value of a standard 200 mm wide block made from a timber aggregate from 0.92R to 2.25R.

The polystyrene insert elements reduces all water and moisture penetration through the block wall. They also improve the ease, speed and accuracy of block laying (especially when using a matrix including timber for the construction blocks), eliminate the need for control or expansion joints and increase bond strength between blocks. The insert elements also contribute to an increase in overall stability of a block wall during earth tremor or quake and decrease the chance of cracking due to movement in the footing or slab. Further, the blocks may be nailed with all size nails and screws without the need for pre-drilling or wall plugs.

The styrene elements are preferably disposed midway of the width formed by two opposing blocks for the following reasons:

a) To provide sufficient thermal mass, to store energy on the inside of the dwelling.
b) Tie down rods or cyclone rods are best placed in the centre of the block. The centre being styrene makes the drilling of holes to house the rods easy.
c) To increase the fire rating and structural integrity of the block wall regardless of whether the fire is on the inside of the house or the outside. The side of the wall that is exposed to flames will eventually lose structural integrity. Due to the centrally mounted styrene insert heat transference is dramatically reduced thus leaving one side of the wall structurally sound.

This composite including block and styrene insert will dramatically improve all cement stabilized blocks and fired clay blocks such as:

1. Typical concrete block blend & cement stabilized mud brick,
2. Foamed air (or aerated concrete products),
3. Concrete products with added low density material such as vermiculite, fly ash, organic products such as products containing cellulose material, i.e., rice husks, sawdust and other organic products
4. The Timbercrete™ blend which is the present Applicant's previous invention.

Blocks manufactured from a cementitious matrix which includes timber derivatives adds to the overall R (thermal rating) value yet has better thermal mass than other products such as foam concrete (aerated concrete). It is light weight yet strong material. This means that the thickness of the Timbercrete section on either side of the styrene insulating element can be wider than conventional bricks or blocks. As a result there is a greater surface face area which means greater bond wrench strength. Also, the overall load bearing capacity of a wall constructed from the blocks is increased. Due to the lighter density and greater surface area of timber based aggregate blocks compared to solid concrete products, are lighter and stronger are non-combustible and have low conductivity, offering a better fire rating than most.

The composite according to the invention including the integral insulating element is non brittle and has elastic memory and thus is less likely to crack when subject to bending pressures. Tests show that a 150 mm long×5 mm wide nail can be hammered directly into the corner of a block without splitting or cracking the block. In the same way any size or shape self tapping screw will enter without the need for pre-drilling or wall plugs.

The blocks may be provided in a variety of shapes and colors offering originality and creativity. According to a method aspect the moulds used in the construction of the blocks may be provided in different shapes and sizes. Setting time is longer than the known method of timber aggregate block construction and a reduced slump parameter is preferred. Regardless of what masonry product is used the viscosity of the matrix is critical to an effective product. The matrix material used must be viscous enough to flow into all formations or wedge shaped keys of the insert elements described above thereby creating a sound bond between styrene insert and its adjacent masonry block. Care must be taken to remove the mould only after prescribed setting times.

Blocks according to the invention have mortar joints which are much thinner (preferably 5 mm) than traditional brick work which is normally 10 to 15 mm thick.

Block corners on the ends and top (one or more sides) may be completed with a pronounced chamfer approximately 20 mm diameter. The chamfer on the corners and edge of the block is preferably rounded. The top and two ends of block face may have a smooth convex shape creating a three sided convex frame with a split face half oval center. When the moulds are removed lifting it in its entirety (without dissembling), a small slump occurs. The slump need only be 1.5-2 mm. The wet blocks subsequently rest against each other in some places. The two blocks will join at random places and when separated random patterns occur.

The composite block including the insulating element is non brittle and has a limited elastic memory with a thin flexible mortar having a strong binding quality, will produce a wall that has many unique qualities. There is a reduced need for control and expansion joints and reduction in the risk of cracking from movement of footings or slabs.

Other insert element with insulating properties can be substituted for polystyrene such as polyurethane, foamed rubber, foamed concrete, vermiculite glued so as to make a board, fly ash also glued together and other low density mineral products. Organic inserts could include glued low density sawdust so as to make a board. In similar fashion the use of straw or other grass like materials. Also rice husks glued together into a board or matted insert could be used as a substitute for a polyurethane insulating element. All such products have been considered but H grade or VH grade extruded styrene is the preferred choice for the following reasons. H grade or VH grade styrene is stronger than most other suggested alternatives. H grade or VH grade styrene has a higher R value per centimeter than the other comparable materials. The cost and ease with which extruded styrene is produced makes it commercially viable.

The styrene insert may vary in thickness to satisfy the particular R value that is needed to meet the required standard that varying climatic conditions and government regulations require. The styrene insert may be offset to one side or the other however a centrally located insert is preferred. Cavity blocks may be constructed but the solid light weight block is preferred because of its greater surface face area for load bearing and bond wrench capabilities. Also, with cavity blocks load bearing requirements often dictate the need to fill the cavity with concrete. This significantly increases the overall costs.

Figure 14:
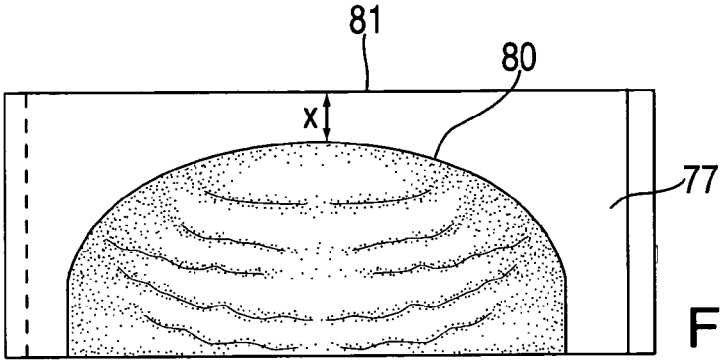
FIGS. 14-16 shows side elevation views of blocks formed from a mould.
Figure 15:
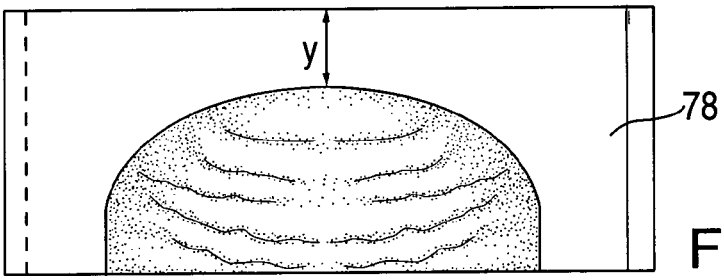
Figure 16:
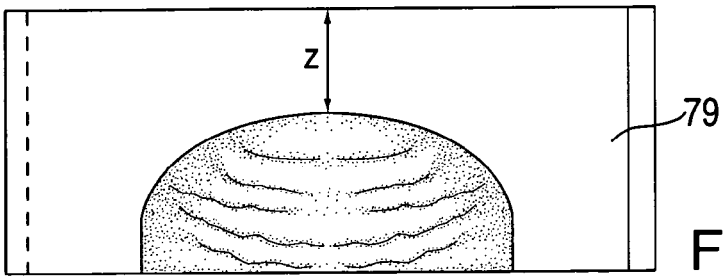

A mould with alternative mould formations may be used for the production of alternative radii blocks according to an alternative embodiment. Thus, depending upon the radius size of the insert selected, this will produce blocks having a rock face with a predetermined radius and therefore a predetermined finish. FIGS. 14, 15 and 16 show side elevation views of blocks 77, 78 and 79 formed using respective mould options so that the block face has a rock face which may be sized to leave respective distances from the top of the blocks 77, 78 and 79 of X, Y or Z for example. The block in FIG. 14 for instance has a rock face profile with a radius of 200 mm diameter. The block in FIG. 15 has a rock face, of 180 mm radius and the block of FIG. 16 has a rock face radius of 150 mm. Thus, as can be seen with reference to FIG. 14 the higher the radius selected for a particular block the shorter the distance between the rock face edge 80 and the edge 81 of the block.

Figure 17:
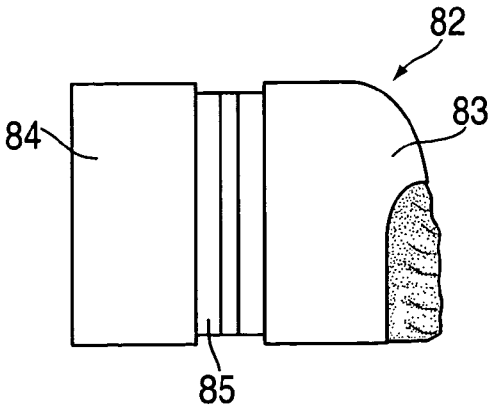
FIG. 17 shows an end view of a wall section comprising a typical rock face block, a flat face block separated by styrene insulating element.

FIG. 17 shows an end view of a wall section 82 comprising typical rock face block 83 and flat face block 84 separated by styrene insulating element 85. Block 70 is shown finished with rock face 73. Thus according to one embodiment, a wall of rock face blocks may be constructed with a rock face finish on an external face and an insulating insert between opposing bricks.

Figure 18:
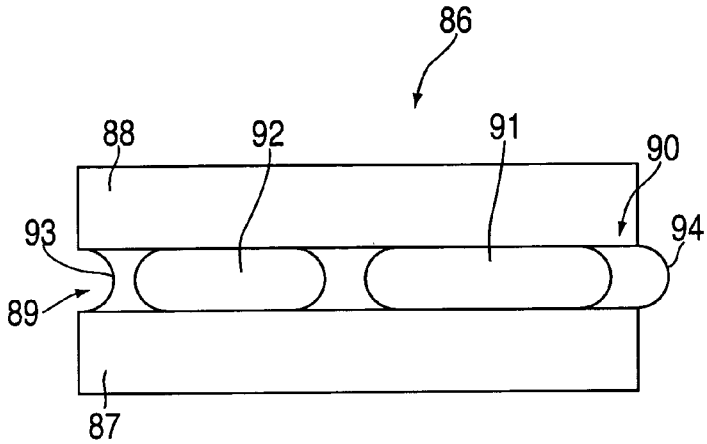
FIG. 18 shows a plan view of a block arrangement with hollow core.

FIG. 18 shows a plan view of a block arrangement 86 comprising a first block 87 and opposing block 88 defining a space 89 therebetween. Space 89 receives and retains therein an element 90 which includes hollow regions 91 and 92. Element 90 may be disposed is in a manner which allows formation of a female gender recess 93 and male profile part 94 which both facilitate opposite gender engagement with end to end opposing blocks (not shown). Hollow regions 91 and 92 cause a lower R value. For opposing blocks of overall width 240 mm the R value will be in the order of R1.5.

Figure 19:
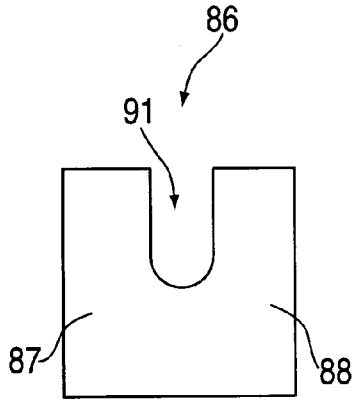
FIG. 19 shows an end view of the arrangement of FIG. 18.

FIG. 19 shows an end view of the arrangement of FIG. 18 with corresponding numbering.

Figure 20:
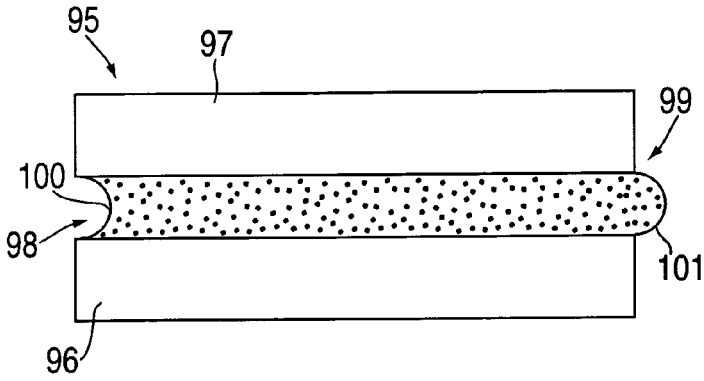
FIG. 20 shows a plan view of a spaced apart block arrangement with polystyrene insulating element.

FIG. 20 shows a plan view of a spaced apart block arrangement with polystyrene insulating element.

Block arrangement 95 comprising a first block 96 and opposing block 97 defining a space 98 therebetween. Space 98 receives and retains therein an element 99 which fills space 98. Element 99 may be disposed is in a manner which allows formation of a female gender recess 100 and male profile part 101 which both facilitate opposite gender engagement with end to end opposing blocks (not shown).

Since element 99 is totally solid, this will facilitate a higher R value in the region of 2.35 depending upon the thickness of blocks 96 and 97.

Figure 21:
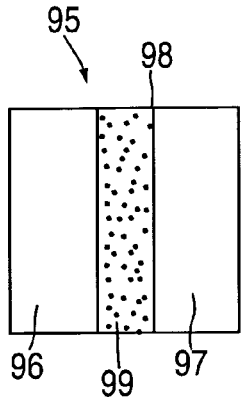
FIG. 21 shows an end view of the arrangement of FIG. 20.

FIG. 21 shows an end view of the arrangement of FIG. 20 with corresponding numbering.

It will be appreciated by persons skilled in the art that numerous variations and modifications may be made to the invention as broadly described herein without departing from the overall spirit and scope of the invention.

The claims defining the invention are as follows:

1. A composite construction block for use in the construction of structures, constructed from a plurality of said construction blocks, the block comprising:

a cementitious body having a bottom surface, a top surface, end surfaces, a first outer surface which forms part of an outer surface of said structure, an opposite second outer surface which forms part of an inner surface of said structure and first and second opposing inner surfaces which form an internal linear space therebetween; and a solid insulating element having a first outer face and a second outer face and which is received and retained embedded in said internal linear space, said insulating element provides thermal insulation for said structure and thermally isolates said first and second outer surfaces of said cementitious body from said opposing second and first inner surfaces respectively of each of said blocks of said structure;

wherein each of said blocks is manufactured in a mold from a cementitious matrix which is poured about said insulating element to form said composite construction block by integral attachment between said cementitious body and said insulating element, said insulating element extending along a majority of a height dimension of said block and along a majority of a length dimension of said block;

and wherein said first and second outer surfaces of said insulating element each include a plurality of dovetail key in lock formations of constant cross section which enable locking of said insulating element to respective first and second inner surfaces of said cementitious body of said block, and wherein said dovetail formations on said first and second outer faces of said insulating element each extend along a height dimension from said bottom surface of said cementitious body to said top surface of said cementitious body, and wherein said insulating element is disposed linearly and oriented in a direction along a central axis of said block, and wherein the width of said insulating element at its widest point is less than one third of the overall width of said block.

2. A composite construction block according to claim 1, wherein:

said dovetail formations on said insulating element provide opposite gender engagement with said cementitious body.

3. A composite construction block according to claim 2, wherein:

said insulating element has at least one end formation which extends beyond said end surface of said cementitious body forming a male profile part.

4. A composite construction block according to claim 3, wherein:

said male profile part of said insulating element engages another composite construction block via a corresponding female recess in an insulating element of an adjacent block.

5. A composite construction block according to claim 4, wherein:

said insulating element is made from a plastics material.

6. A composite construction block according to claim 5, wherein:

a height dimension of said insulating element extends beyond an overall height dimension of said cementitious body.

7. A composite construction block according to claim 6, wherein:

said insulating element is made from a resin material.

8. A composite construction block according to claim 6, wherein:

said insulating element is made from polystyrene material.

9. A composite construction block according to claim 7, wherein:

said block is a three dimensional polygon.

* * * * *